United States Patent [19]

O'Connell

[11] Patent Number: 4,986,366

[45] Date of Patent: Jan. 22, 1991

[54] METHOD AND APPARATUS FOR SUPPRESSING EXPLOSIONS AND FIRES

[76] Inventor: Michael O. O'Connell, Knockaneady, Ballineem, County Cork, Ireland

[21] Appl. No.: 382,049

[22] Filed: Jul. 19, 1989

Related U.S. Application Data

[63] Continuation of Ser. No. 172,817, Mar. 25, 1988, abandoned.

[30] Foreign Application Priority Data

| | | | |
|---|---|---|---|
| Mar. 25, 1987 | [IE] | Ireland | 770/87 |
| May 7, 1987 | [IE] | Ireland | 1129/87 |
| Jun. 24, 1987 | [IE] | Ireland | 1673/87 |
| Sep. 18, 1987 | [IE] | Ireland | 2524/87 |

[51] Int. Cl.[5] ..... A62C 35/00

[52] U.S. Cl. ..... 169/66; 169/8; 169/20; 169/71; 169/58; 169/26; 137/68.1

[58] Field of Search ..... 169/8, 11, 17, 20, 22, 169/36, 71, 73, 57, 58, 66; 222/146.5, 3, 61, 394, 541; 137/68.1; 219/280, 281, 316, 307; 261/DIG. 23; 239/309, 128

[56] References Cited

U.S. PATENT DOCUMENTS

| | | | |
|---|---|---|---|
| 1,485,913 | 3/1924 | Gottlieb | 137/68.1 |
| 2,387,353 | 10/1945 | Raymond | 137/68.1 X |
| 3,092,286 | 6/1963 | Duff | 137/68.1 X |
| 3,777,772 | 12/1973 | Arnold et al. | 137/68.1 |
| 3,871,457 | 3/1975 | Livingston | 169/20 |
| 3,910,498 | 10/1975 | Harrison | 222/146.5 X |
| 4,051,982 | 10/1977 | Stetson | 222/3 X |
| 4,253,527 | 3/1981 | Wilhoit | 169/57 |
| 4,320,702 | 3/1982 | Shein et al. | 222/146.5 X |
| 4,378,851 | 4/1983 | de Vries | 169/45 |
| 4,394,868 | 7/1983 | McLelland | 169/58 |
| 4,469,247 | 9/1984 | Tompkins | 222/3 |
| 4,551,613 | 11/1985 | Yashfe | 219/316 |
| 4,580,589 | 4/1986 | Le Bras et al. | 137/68.1 |
| 4,583,597 | 4/1986 | Spector et al. | 169/61 |

FOREIGN PATENT DOCUMENTS

| | | | |
|---|---|---|---|
| 205039 | 11/1983 | Japan | 219/281 |
| 792645 | 12/1985 | U.S.S.R. | |

*Primary Examiner*—Joseph F. Peters, Jr.
*Assistant Examiner*—Christopher P. Ellis
*Attorney, Agent, or Firm*—Sughrue, Mion, Zinn, Macpeak & Seas

[57] ABSTRACT

Apparatus for suppressing explosions comprises a reservoir means containing hot pressurized water which is heated by a heating means. On explosion conditions occurring in an enclosure a high speed differential pressure diaphragm is fractured to release a charge of hot pressurised water into the enclosure. When the water enters the enclosure portion it is converted into water droplets to suppress the flame front of a deflagration and portion of the water flashes off as flash steam to reduce the oxygen concentration and suppress the explosion. A differential pressure diaphragm 40 comprises a pair of bursting diaphragms having a space therebetween which is maintained at a balance pressure. When explosion conditions occur the balance is disturbed and the diaphragms burst under the higher pressure.

19 Claims, 6 Drawing Sheets

METHOD AND APPARATUS FOR SUPPRESSING EXPLOSIONS AND FIRES

This is a continuation of application Ser. No. 07/172,817, filed 3/25/88 abandoned.

BACKGROUND OF THE INVENTION

The invention relates to a method and apparatus for suppressing, extinguishing or inhibiting a fire or an explosion in an area.

The term "enclosure" as used in this specification refers to any space having a boundary such as a duct, a cavity, a vessel, a spray dryer, cyclone, silo, fluidizer beds, the hold of a ship, a conveyor, a storage tank, a pump house or the like which may be opened or closed and which may be at any pressure (i.e. above or below atmospheric pressure) or temperature (i.e. above or below ambient temperature).

Various appliances are available to contain or suppress dust explosions in vessels such as dryers, cyclones, connecting duct work, fluidizer beds and powder silos of milk drying plants. All suppression appliances operate on the principle that an explosion is not instantaneous but takes a measurable time, in the order of from 40 to 400 milliseconds to build up to destructive pressure. During a first phase the rate of pressure rise is low, the maximum pressure reaching approximately 1.5 psi. Thereafter the rate of pressure rise rapidly increases, generating up to 100 psi in a second phase. The duration of the pressure rise phases is dependent on the size and geometry of the enclosure in which the explosion occurs Generally it is recognized that to adequately suppress an explosion the initiating ignition must be suppressed and extinguished within periods of the order of from 10 to 200 milliseconds. To satisfy this requirement the response time of conventional suppression appliances must be very short.

Generally, conventional suppression appliances comprise a detector for detecting the pressure rise caused by an explosion at an early low pressure stage of approximately 0.5 psi. When explosion condition occurs in an enclosure, a control system outputs a signal to burst a diaphragm at the outlet of a suppression charge vessel which introduces a charge of explosion suppressant material into the enclosure. Such suppression systems interrupt particle heat transfer, breaking the combustion chain and preventing rapid pressure rise.

There are three commonly available suppressants in use. These are chlorobromethane (Halon 1011), monoammonium phosphate based dry powder (MAP), and water. It has been reported by Moore in The Chemical Engineer, November 1986 and December 1984 that Halon 1011, MAP powder and water are effective in suppressing explosions. The effectiveness of these three different types of suppressants however varies depending on the nature of the explosion. Halon and MAP may contaminate vessels into which they are introduced and this is a considerable disadvantage, particularly in the food industry. Conventional water suppressors have a short period of effectiveness and their use involves a greater risk of reignition Somewhat similar comments apply to the extinguishing of fire in any area. "Fire" in this connection refers to a flame front moving at any speed and not only to an explosion which may be characterised as a fast moving fire. The distinction between the terms "fire" and "explosion" is not clearly defined and, where the context allows, the expressions may be interchanged when reading this specification.

SUMMARY OF THE INVENTION

There is therefore a need for an improved method and apparatus for suppressing, extinguishing or inhibiting a fire or an explosion.

This invention is directed towards providing such an improved method and apparatus.

According to the invention there is provided an apparatus for suppressing, extinguishing or inhibiting a fire or an explosion in an area comprising reservoir means for pressurised water and heating means for heating the water, the reservoir means having an outlet means, the outlet being closed by a valve means which is opened in response to fire or explosion conditions occurring in the area to introduce pressurised hot water from the reservoir means into the area at a pressure higher than that in the area, a portion of the water fragmented by flash steam forming a vapour cloud on introduction into the area and a portion of the water flashing off as steam on entry to the lower pressure area to suppress, extinguish or inhibit a fire or an explosion.

One advantage of using pressurised hot water is that, in addition to using the already proven suppressant characteristics of water, flash steam is also used which, on expanding from unit working pressure to atmospheric pressure, imparts additional velocity, and consequently the reaction time in suppressing explosions or extinguishing fires is very fast. Further, the water droplets and flash steam assist in preventing re-ignition of a secondary fire or explosion. In addition, because the supressant material is freely available and is easily charged into a suppressant reservoir, it will be considerably cheaper than existing suppression systems. In addition, the suppressant is safe, non-contaminating, non-corrosive and non-toxic.

In one particularly preferred embodiment of the invention the apparatus is for suppressing an explosion in an enclosure, and comprises reservoir means for pressurised water and heating means for heating the water, the reservoir means having an outlet means into an enclosure, the outlet being closed by a valve means which is opened in response to explosion conditions occurring in the enclosure to introduce pressurised hot water from the reservoir means into the enclosure, portion of the water forming droplets on introduction into the enclosure to suppress a developing flame front, and a portion of the water flashing off as steam on entry to the lower pressure enclosure, the steam and water droplets reducing the oxygen concentration and inhibiting particle heat transfer in the enclosure to inhibit the explosion.

In one embodiment of the invention the reservoir means comprises a pipeline having an outlet means into an enclosure. Preferably the pipeline comprises a ring main extending substantially around the enclosure and having a plurality of spaced-apart outlet means into the enclosure. The heating means may comprise means for heating the pipe, such as a steam or electrical trace heater or a hot air dryer.

In another embodiment of the invention the reservoir means comprises a pressurised suppression vessel. In this case the heating means may comprise and electrically powered heating element. Alternatively the heating means may comprise a heating coil through which steam is led to heat the water in the pressurised suppression vessel.

In one embodiment of the invention the outlet valve means comprises a diaphragm means.

In a particularly preferred embodiment of the invention the diaphragm means comprises a differential pressure diaphragm comprising two spaced-apart diaphragms defining therebetween a pressurised space, the pressure in the space being relieved to allow bursting of the diaphragms in response to preset conditions. The differential pressure maintained in the space may be released on activation of a solenoid valve in response to explosion conditions occurring in an enclosure communicating with the diaphragm.

In one embodiment of the invention, means are provided to minimise the air space between the diaphragms. In one case the space may be pressurised with an incompressible fluid, such as water, or a high boiling point inert liquid, such as glycol. In another case the space may be partially filled with an insert which is ejected from the diaphragms, on bursting. The insert is preferably of an inert, preferably water soluble material.

In another embodiment of the invention the apparatus includes means for detecting explosion conditions in an enclosure and control means for bursting the diaphragm to release a charge of pressurised hot water into the enclosure in response to activation of the explosion conditions detector.

The means for detecting the explosion conditions in the enclosure may comprise a membrane pressure detector, a pressure transducer, a U tube detector, a heat sensor or an infra red detector.

In a further preferred aspect of the invention the apparatus is for extinguishing a fire in an area and the apparatus comprises reservoir means for pressurised water and heating means for heating the water, the reservoir means having an outlet means closed by a valve means which is opened in response to fire occurring in the area to introduce pressurised hot water into the area at a pressure higher than that in the area, a portion of the water fragmented by flash steam forming a vapour cloud on introduction into the area and a portion of the water flashing off as steam on entry to the lower pressure area to extinguish or inhibit a fire.

In one embodiment of this aspect of the invention the reservoir means includes a pressurised suppression vessel containing pressurised hot water, the reservoir having outlet means for delivery of hot pressurised water into the area, the outlet means being closed by a valve means which is opened on fire occurring in the area. Preferably the outlet includes a pipeline extending around or along at least portion of an area, the pipeline having a plurality of outlets into the area.

In another embodiment of this aspect of the invention the reservoir means includes a pipeline having a plurality of outlets into the area, the heating means comprising a steam or electrical heater or a hot air dryer. Preferably the valve means comprises a solenoid valve.

In a further aspect the invention provides a method of suppressing, extinguishing or inhibiting a fire or an explosion in an area comprising the step of introducing a charge of hot pressurised water into the area at a pressure higher than that of the area so that a portion of the water fragmented by flash steam forms a vapour cloud on introduction into the area and a portion of the water flashes off as steam on entry to the lower pressure area to suppress, extinguish and inhibit a secondary fire or an explosion.

In another aspect the invention provides a method of suppressing an explosion in an enclosure comprising the step of introducing a charge of hot pressurised water into the enclosure at a pressure higher than that of the area so that a portion of the water fragmented by flash steam forms a vapour cloud on introduction into the area to suppress a developing flame front of a deflagration and a portion of the water flashes off as steam on entry to the lower pressure area enclosure to reduce the oxygen concentration from the atmosphere in the enclosure to inhibit the explosion or extinguish a fire and prevent secondary re-ignition.

In a further aspect the invention provides a differential pressure diaphragm comprising two spaced-apart diaphragms defining therebetween a pressurised space, the pressure in the space being relieved to allow bursting of the diaphragms in response to preset conditions.

In one embodiment of this aspect of the invention the differential pressure maintained in the space is released on activation of a valve in response to explosion conditions occurring in an enclosure communicating with the diaphragm.

In a preferred embodiment of the invention means are provided to minimise the air space between the diaphragms.

In one case the space is pressurised with an incompressible fluid such as water or a high boiling point inert liquid.

In another case the space is partially filled with an insert which is ejected from the diaphragms, on bursting.

The insert may be of an inert, preferably water soluble material.

BRIEF DESCRIPTION OF THE DRAWINGS

The invention will be more clearly understood from the following description thereof given by way of example only with reference to the accompanying drawings in which.

DETAILED DESCRIPTION OF THE PREFERRED EMBODIMENTS

Figure 1:
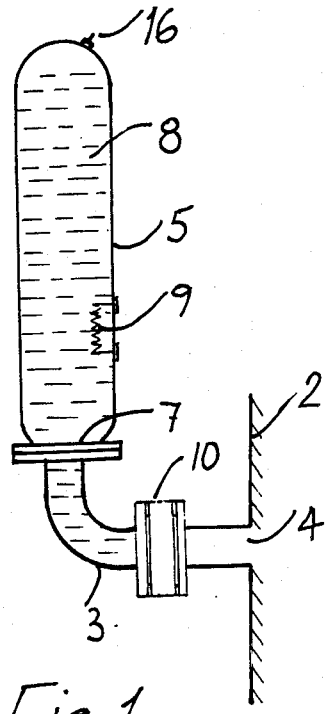
FIG. 1 is a diagrammatic side view of an apparatus according to one embodiment of the invention.
Figure 3:
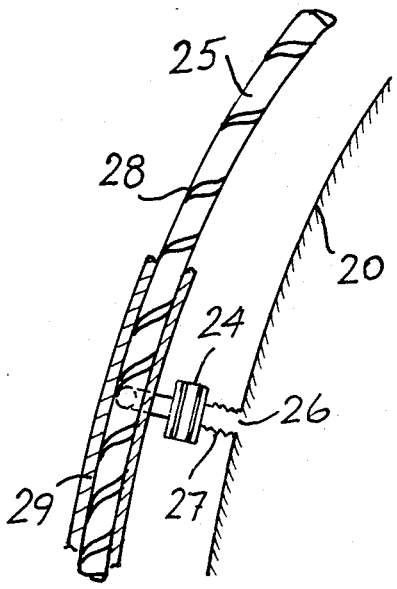
FIG. 3 is a plan, partially cross sectional view of one portion of the apparatus of FIG. 2 in use on a spray dryer.
Figure 5:
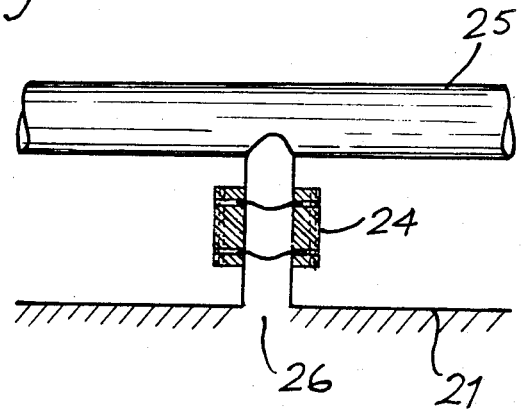
FIG. 5 is a side, partially cross sectional view of another portion of the apparatus of FIG. 2 in use on a cooling bed.
Figure 4:
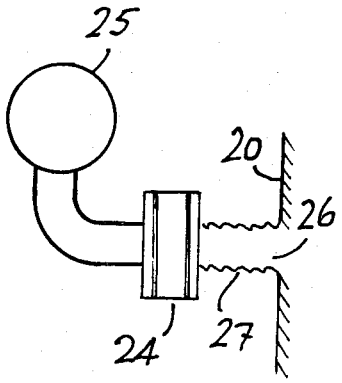
FIG. 4 is a side view of the portion of FIG. 3.
Figure 2:
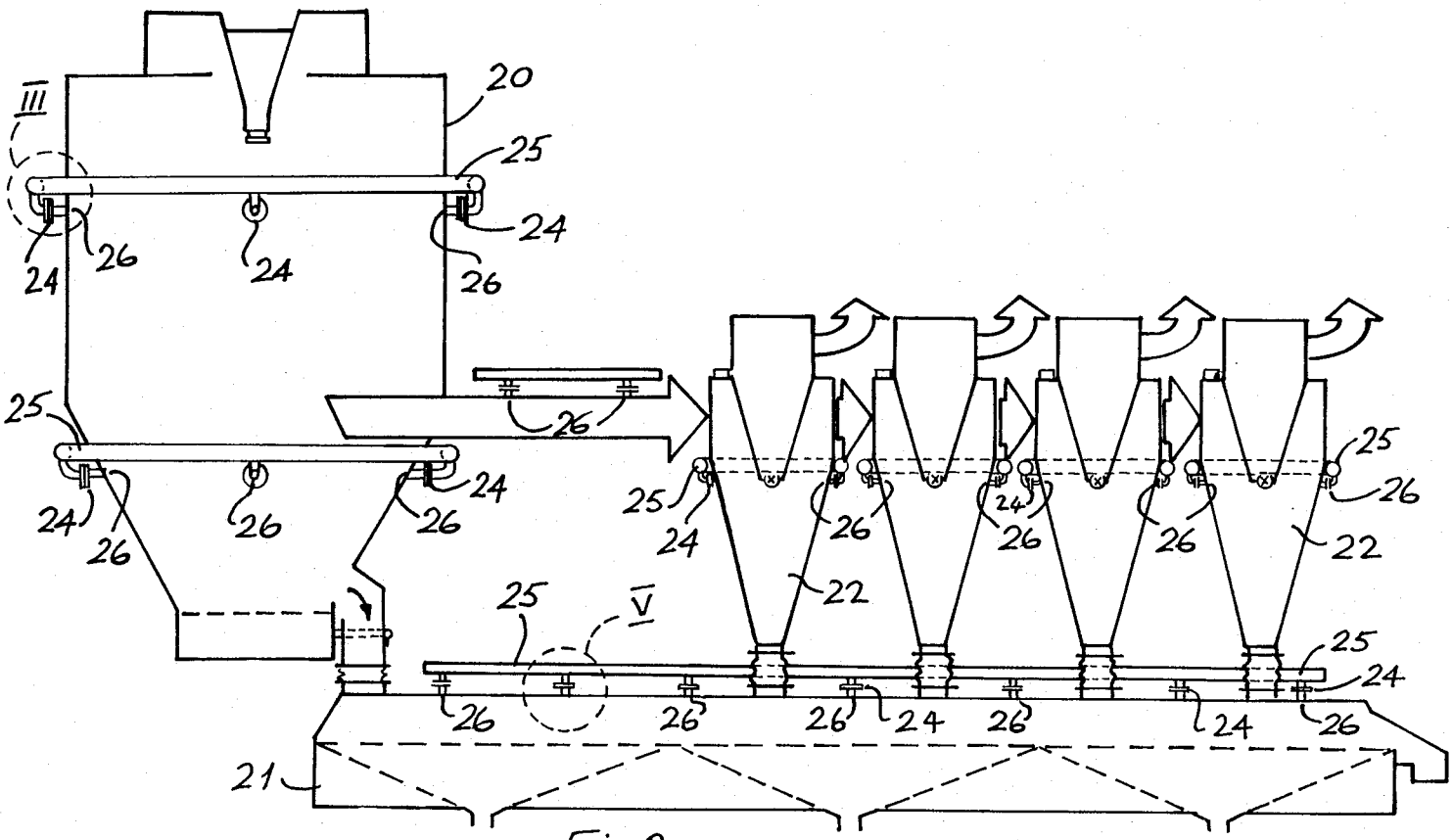
FIG. 2 is a schematic view of an apparatus according to another embodiment of the invention, in use on a drying plant.

Referring to the drawings and initially to FIG. 1 thereof there is illustrated an apparatus 1 for suppressing, extinguishing or inhibiting a fire or an explosion in an area. In this case the apparatus 1 is particularly adapted for suppressing explosions in an enclosure 2. The apparatus 1 comprises a reservoir which in this case comprises a pressurized suppression unit 5. The unit 5 in this case is of generally cylindrical shape having an outlet 7 connected by an elbow piece 3 to an inlet opening 4 to the enclosure 2. A charge 8 of water is introduced into the suppression unit 5 and is heated in the unit by a heating means, in this case comprising an electrical heating element 9, which heats the water to a temperature which is below the boiling point of the water at the particular pressure maintained in the unit 5. Pressure in the suppression unit 5 is maintained by air or any suitable inert gas. In this case where the unit is not pre-pressurized unit pressure is provided by the steam generated.

The outlet 7 of the suppression unit 5 is sealed by a valve means which in this case comprises a high speed differential pressure diaphragm 10 which, as will be described in more detail below, is fractured to release a charge of water from the suppression unit 5 into the enclosure 2 in response to explosion conditions occurring within the enclosure 2. A diffuser may be provided at the inlet 4 to the vessel 2 to direct the charge of pressurised hot water into the enclosure 2 on bursting or fracturing of the differential pressure diaphragm 10.

In use, a charge of water is introduced into the suppression unit 5 through a filling port 16 and the water is pressurised to the desired pressure, for example 500 psi. The water is then heated using the heating element 9 to the desired temperature, which is less than the boiling point of the water at the pressure in the suppression unit. In the case of the pressure of 500 psi the water may be heated to a temperature of 450 degrees F. Control means may be used to maintain the temperature and pressure at the correct levels. Pressure may be provided by compressed gas, such as air or nitrogen, or by the heating effect of the water charge, or by a combination of both.

If explosion conditions occur in the enclosure 2 an explosion conditions detector, for example a diaphragm detector, sends a signal through a control system to fracture the diaphragm 10 to release a charge of pressurized hot water from the suppression unit 5 into the enclosure 2. Because the water is at a substantially higher pressure than that in the enclosure 2, when the water enters the enclosure a portion of it is converted into water droplets to suppress the flame front of a deflagration, and a portion of the water flashes off as flash steam to reduce the oxygen concentration in the atmosphere. The flash steam vapour cloud remains in suspension in the enclosure and hence prevents a secondary explosion.

When water under pressure is heated the temperature is raised so that the liquid heat of the water is also raised. The liquid heat of the high temperature, high pressure water is released at lower temperatures in the form of latent heat and flashes off a percentage of the liquid in the form of flash steam. Above 70% of the liquid can be flashed off at atmospheric pressure. On discharge, the water element behaves conventionally, forming water droplets to suppress the deflagration. In addition, the flash steam reduces the oxygen concentration in the enclosure to below a level which will support combustion and prevents re-ignition.

The initial charge of pressurized hot water may be followed by a continued steam discharge from a process steam line on bursting of the diaphragm 10 or by activation of a fixed water spray system to assist in maintaining suppression conditions and preventing reignition within the enclosure.

It will be appreciated that the suppression reservoir may be connected to the enclosure wall by a section having a flexible spool to take-up weight and reaction from the enclosure 2. To maintain sterility in the enclosure a discharge pressure blow out plug may be provided at the outlet to the enclosure.

It will be appreciated that the discharge time for the pressure suppression vessel is proportional to the pressure, the area of the discharge nozzle and the distance to be travelled. Various designs of nozzle may be used to attain the best effect and the suppression units may be fitted on a number of different locations around an enclosure to achieve the best effect.

The method and apparatus according to the invention makes it possible to enhance water properties, providing a unique combination of suppressant qualities plus inerting qualities.

A second major advantage is that as the unit discharges the volume increase created is immediately occupied by flash steam. This creates a condition where the unit discharge pressure is almost constant. As the pressure remains substantially higher using pressurised hot water rather than an inert gas such as nitrogen the discharge velocity $V_1$ also is higher.

The third major advantage of the method is that, as only a fraction of the surplus heat is used to self propel the water from a reservoir, the remaining surplus heat is available to do other work. This surplus heat under atmospheric conditions regains thermal equilibrium by converting to steam. In converting to steam it expands enormously compared to its liquid condition. For example 1 kg of water occupies a vol. of 0.001 cu.m., 1 kg of steam at atmospheric occupies a vol. 1.673 cu.m. Therefore the steam now occupies a volume 1630 times greater than its original. This large expansion imparts a very large secondary velocity V2. The expansion also explodes the water into very fine particle sizes akin to molecular fragments. This forms a cloud of vapour which remains in suspension, suppressing an explosion and effectively preventing secondary re-ignition.

The unique combination of the almost constant discharge pressure giving V1 combined with the secondary velocity V2 enable the suppressor units to be designed to very low pressures of 2 to 10 Bar and still maintain velocities in excess of higher charged units. Because the system uses freely available suppressant material which is easily charged into the suppression vessel, it will be considerably cheaper than existing suppression systems.

In addition, because the suppression system pressure can be controlled, it can easily be switched off for inspection or cleaning of the enclosure to which it is attached. Further, the pressure in the vessel can be easily varied thermostatically by controlling the temperature. Further, the suppressant used is safe, non-contaminating, non-corrosive and non-toxic.

In the method and apparatus according to the invention, on discharge of the pressurised hot water charge as the pressure drops, flash steam will immediately fill the volume of the suppressor unit and maintain substantially constant pressure. Thus, the suppression vessels can be discharged at a substantially constant high pressure to give a considerably faster response time. In conventional arrangements the suppressor units are pressurised with a propellant gas. As the suppression vessel is discharged the propelling gas loses pressure, thus increasing the time required to discharge the suppressant charge. To compensate, usually a very high pressure is required. The method and apparatus according to the invention, however, does not have this problem because of the compensating discharge pressure improvement involving flash steam and steam expansion.

In addition, the enclosure is inerted against secondary re-ignition by saturation, heat transfer interference and oxygen reduction.

Depending on the characteristics of the material being handled re-ignition may be prevented by particle wetting. In this case the operating parameters are calculated and on the basis of the maximum dust or powder concentrations the volume of the water charge required to increase the moisture content of the particles to the level at which re-ignition would not occur is calculated. This is particularly important for hygroscopic dusts such as skim milk powder.

The cloud of steam and atomised water particles remain in suspension, in use, providing a barrier of moisture between the dust particles to prevent re-ignition.

The steam also substantially reduces the level of oxygen to a level, which will not support re-ignition. The volume of steam used is such as to reduce the air and steam mixture to approximately 14% by volume. The following calculation may be used to determine the weight of water that is required to be heated to produce the required volume of steam at atmospheric pressure.

Vessel volume = V for a volume V of air there is 0.22 V of $O_2$ and 0.78 V nitrogen To achieve 14% $O_2$:

$$\frac{14}{100} = \frac{0.22\,V}{V + x}$$

where x is the added gas/steam volume

Solving this equation gives x = 0.57 V

The volume occupied by 1 lb of steam at atmospheric pressure is 26.8 $ft^3$/lb.

Thus, the weight of steam required is $$= \frac{0.57\,V}{26.8} = 0.02\,V \text{ lbs } 1$$

Different operating pressures give different flash steam volumes. At an operating pressure of $P_o$ the amount of flash steam is dependent on the liquid heat $h_L$ at the operating pressure $P_o$ and on the atmospheric conditions which are latent heat L = 970.4 Btu/lb and liquid heat $h_L$ = 180 Btu/lb.

Therefore the amount of flash steam available for unit weight of pressurised hot water is $$\frac{h_L(\text{at } P_o) - 180}{970.4}$$

Combining equation 1 above the total weight (W) of water that is required to be heated to the operating conditions of $P_o$ can be calculated as $$W = \frac{0.02\,V \times 970.4}{h_L(\text{at } P_o) - 180} = \frac{20.7\,V}{(h_L(\text{at } P_o) - 180)}$$

where

V = Vessel volume in $ft^3$ $h_L$ = liquid heat at operating pressure $P_o$

W = weight (in pounds) of water to be heated to give the desired content of flash steam at atmospheric pressure to reduce the oxygen concentration in the vessel to 14% by volume.

For enclosures to be protected, normally a number of suppression apparatus units according to the invention will be mounted to the enclosure at pre-selected locations to give maximum spreading and explosion suppressant characteristics.

The units can be designed to suppress or extinguish confined deflagration of practically all gases, vapours, dusts and would have specific application to petrochemical, chemical, pharmaceutical, food and agri based industries.

Example

An explosion suppression test apparatus was designed with reference to International Standard ISO 6184. The vessel was cylindrical having a volume of approximately 2.5 $m^3$ and an aspect ratio of 2. The dust dispersion mechanism comprised two sets of spray rings, each having 15 spray holes having an orifice diameter of 5 mm. Each spray ring was fed from a 5 liter powder pot. Ignition was by two pyrotechnic igniters having a total energy of 10 KJ. The igniters were fired with a low voltage source under the control of a PLC which determines a fixed delay after dust dispersion. Powder is released from the pots and sprayed into the vessel. After a fixed delay, which is typically 600 milliseconds the igniters are fired and two pressure transducers record the changes in pressure.

Figure 6:
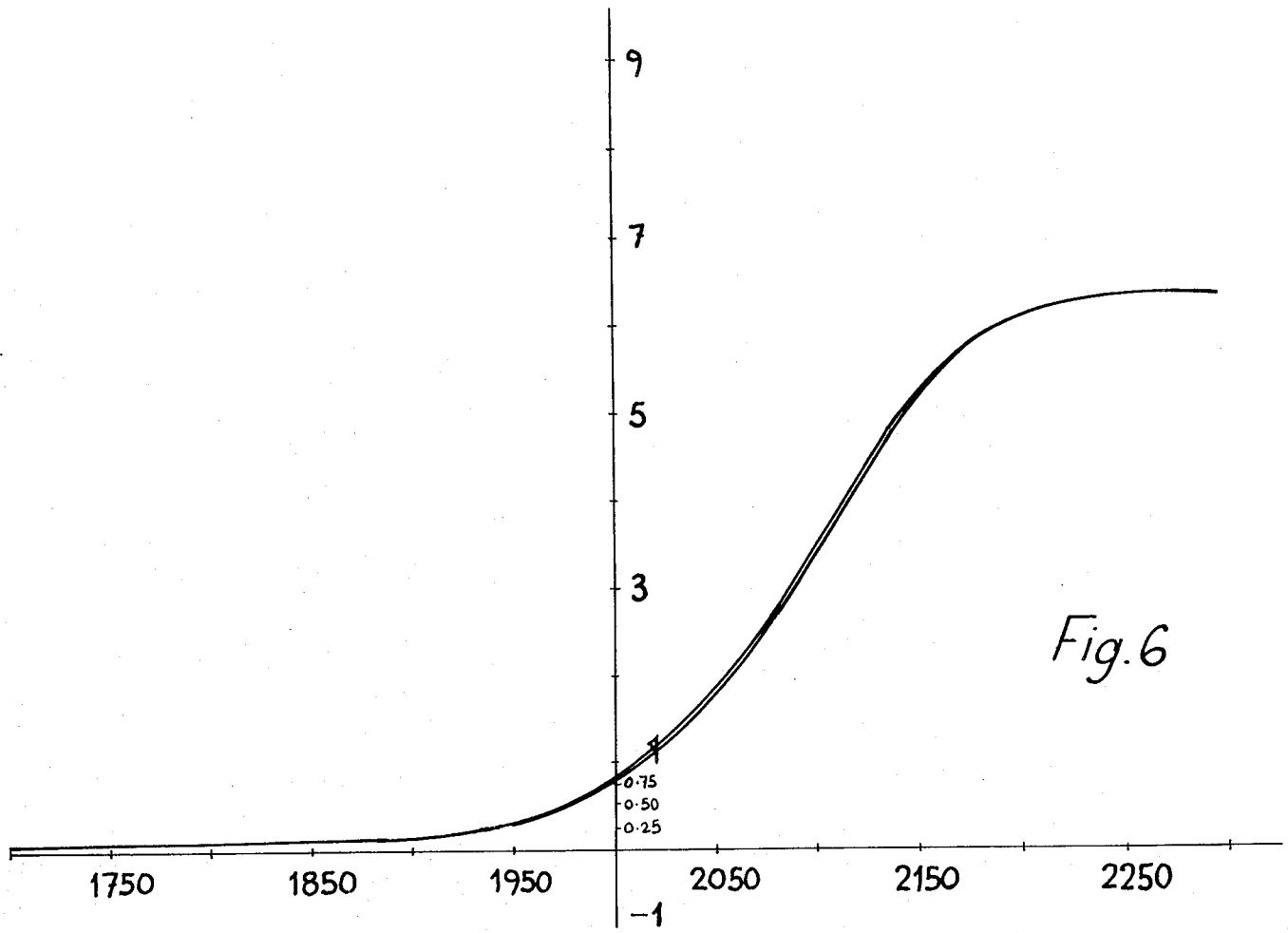
FIG. 6 is a graph of pressure rise over time of an unsuppressed explosion.

An unsuppressed explosion test was first carried out on skim milk powder and the resultant graph of pressure in bar over time in milliseconds is illustrated in FIG. 6. In FIG. 6:

X axis - each step 50 milliseconds
Y axis - each step 1 bar
mid time - 2000 milliseconds
ignition time - 1758.64 milliseconds
valve time - 978.658 milliseconds
maximum pressure - 6.3 bar.

It will be noted that there is an initial phase in which the rate of pressure rise is relatively low followed by a second phase with a high rate of pressure rise.

A suppressed explosion test using pressurised hot water was then carried out in the same vessel, under the following conditions and using the same material as for the unsuppressed explosion test.

Figure 7:
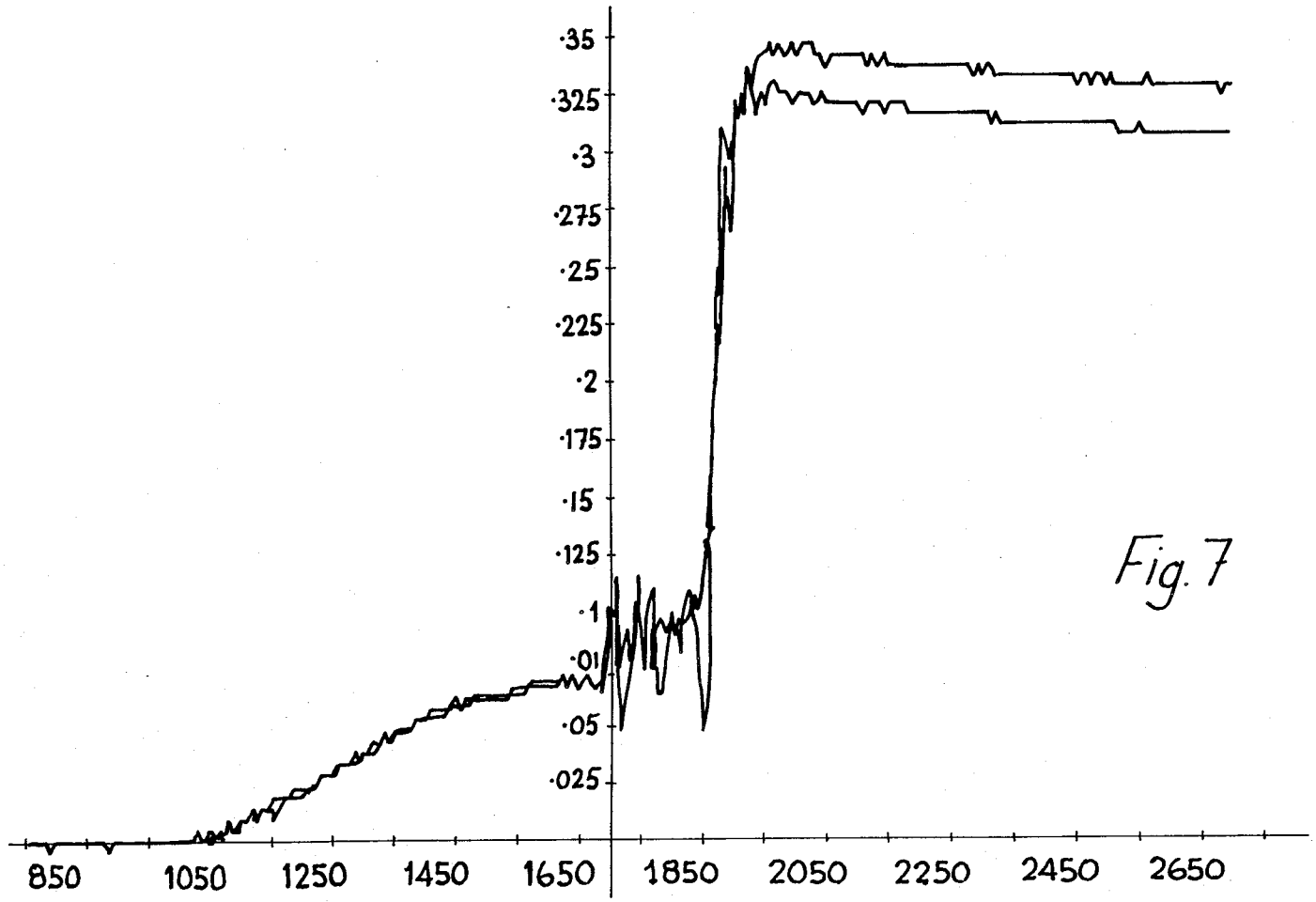
FIG. 7 is a graph of pressure rise over time of an explosion suppressed using the method and apparatus of the invention.

Pressure 9.1 bar gauge
Temperature 180° C.
Water volume 1.5 liters
Water volume/$m^3$ of vessel = 0.65 liters/$m^3$
Discharge diameter = 3"
No nozzle The resultant graph of pressure in bar over time in milliseconds is illustrated in FIG. 7. In FIG. 7:

X axis - each step 100 milliseconds
Y axis - each step 0.025 bar
mid time - 1750 milliseconds
ignition time - 1737.22 milliseconds
valve time - 949.583 milliseconds.

It will be apparent from FIGS. 6 and 7 that the maximum pressure is reduced by the suppression method and apparatus of the invention from approximately 6.3 bar to approximately 0.35 bar, thus suppressing the explosion. This is achieved cheaply, safely, quickly, and using a suppressant which will not contaminate the vessel.

Referring to FIGS. 2 to 5 there is illustrated an explosion suppression apparatus according to another embodiment of the invention which is illustrated in use on a spray dryer 20, a cooling bed 21, a bank of cyclones 22 and connecting ducts. The apparatus comprises reservoirs, in this case main pipelines 25 for pressurised water each having a plurality of spaced-apart outlets 26 each closed by a valve means such as a differential pressure diaphragm 24 which are fractured on explosion conditions occurring in the enclosure to release the charge of hot pressurised water into the enclosures. Each outlet 26 is connected to the enclosure 20, 21 or 22 by a flexible stainless steel bellows 27. Water in each pipeline 25 is heated by an electric surface heat tracing 28 which is thermostatically controlled to maintain a desired temperature of pressurised water in the pipeline 25. Heat insulation 29 (only a portion of which is illustrated in the drawings) is provided, for each pipeline 25 and the discharge outlets 26. Pressurised suppression vessels may be provided for at least the larger diameter ring main pipelines for additional reservoir capacity. The ring main pressurised pipeline can also be used without a reservoir by only partially filling the line with water and allowing space for expanded water and head space for flash steam.

One advantage of using a ring pipeline arrangement for suitably shaped enclosures such as the dryer 20 and cyclones 22 is that it can easily self sustain the discharge thrust of the pressurised water as it is discharged.

Electrical trace heating allows the temperature to be more easily and efficiently controlled and it maintains a uniform temperature which ensures a balanced discharge. In addition, the pipeline units, whether in ring form or in straight sections, may be readily manufactured to suit any desired application.

It will be noted that to facilitate discharge and to maintain headspace and pressure each of the outlets from the suppression unit, whether vessel or pipeline is arranged to provide a filled leg between the reservoir and the discharge into the enclosure.

Figure 8:
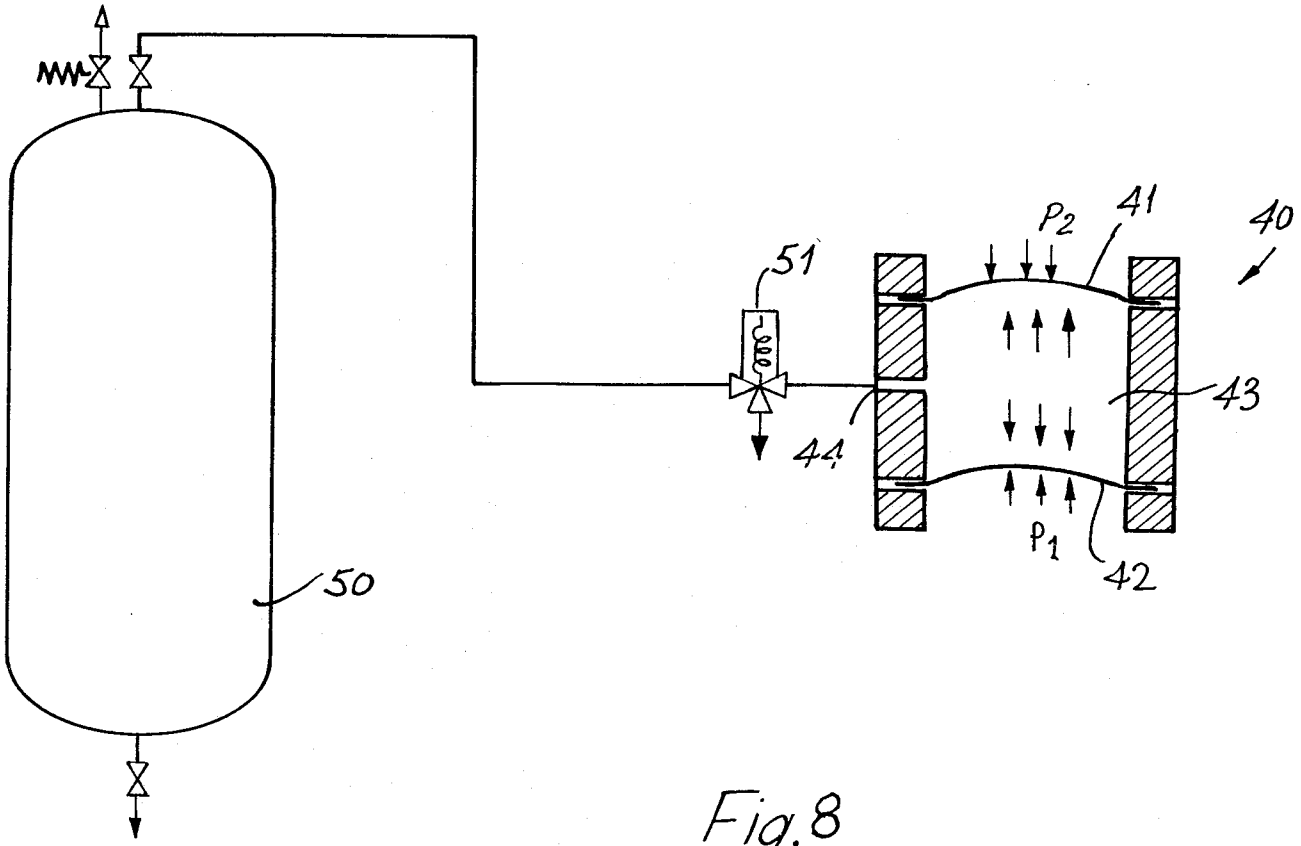
FIG. 8 is a flow diagram of a differential pressure diaphragm according to the invention, in use.

Referring to FIG. 8 there is illustrated a diaphragm unit 40 according to the invention which may be utilised in the explosion suppression apparatus described above. The diaphragm unit 40 comprises a pair of bursting diaphragms 41,42 which are spaced-apart to define therebetween a pressurised space 43 which is pressurised from an air or gas reservoir 50 through an inlet port 44. The outer 41 of the diaphragms is exposed to a pressure $P_2$ in the pipeline in which the unit is mounted and the inner diaphragm 42 is exposed to a pressure $P_1$ in an enclosure, which is typically, but not necessarily, atmospheric pressure.

The balance pressure $P_3$ (200 psi) maintained in the space 43 allows a 300 p.s.i. rated diaphragm to contain a higher pressure of discharge unit of say 400 p.s.i. In the event of explosion conditions occurring in an enclosure the differential pressure in the space 43 is relieved, for example by a solenoid 51, allowing the higher pressure from the explosion suppression reservoir 50 to burst the two diaphragms 41,42 and discharge into the enclosure. Air supply from the vessel 50 to the space 43 is shut off during discharge to prevent air discharge into the enclosure.

In the case of the diaphragm illustrated in FIG. 8 the evacuation time to reduce the internal pressure in the space 43 is the time taken to reduce the internal pressure from 200 psi to 100 psi. At this stage the discharge unit pressure is equal to the diaphragm burst pressure of 300 psi and the diaphragms start to yield. The evacuation time measured in milliseconds is dependent on the volume to be evacuated and in this case corresponds to the time required to reduce the pressure in the space 63 from 200 psi to 100 psi.

The differential pressure diaphragm units may be sealed and the differential pressure released by an electrically operated detonator, a solenoid release valve or the like.

The volume of the space 43 is preferably kept to a minimum to facilitate rapid response. Preferably the space 43 is at least partially filled with an insert which substantially reduces the volume of the space filled with air and consequently the estimated time to evacuate the air to the activation pressure is substantially reduced. For example, for a space volume of 340 $cm^3$ reduced to 15 $cm^3$ by an insert the estimated time for evacuation is reduced from 16 milliseconds to approximately 2 milliseconds. Thus, the diaphragms rupture almost instantaneously allowing an explosion to be suppressed extremely quickly. The insert may typically be of an inert material which may be water soluble. The insert also assists in reducing heat loss as it acts as an insulation barrier.

Alternatively , the space 43 between the diaphragms may be filled with an incompressible fluid such as water. The water may be pressurised with an air/gas mixture to effectively 200 psi, thus maintaining the differential pressure. On explosion conditions occurring a solenoid is activated which vents the space 43 to atmosphere. The water instantly loses pressure and is subjected to the much higher vessel pressure of 400 psi as also is the vent to atmosphere. Thus, both diaphragms burst instantaneously.

It will be appreciated that the diaphragms described above will have wide application in fields other than explosion suppression or fire extinguishing and the invention is therefore not limited to the diaphragms when incorporated in an explosion suppression system. The invention also relates to the differential pressure diaphragms per se.

As well as the potential for explosion suppression of confined deflagrations the pressure hot water system may also be used for extinguishing fires including fires involving flammable liquids or gases, surface fires involving flammable solids and deep seated fires beneath the surface of a particulate or fibrous material.

Figure 9:
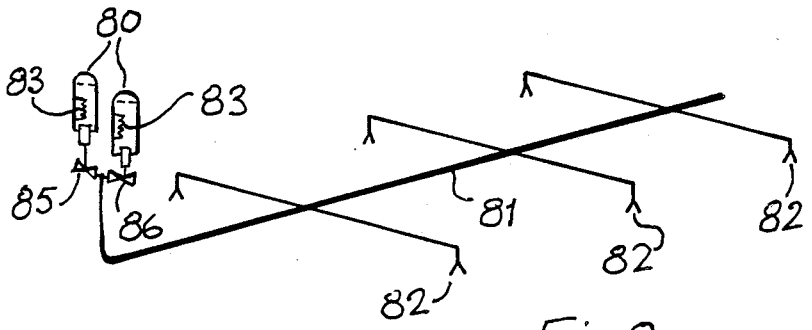
FIG. 9 is a schematic perspective view of another apparatus according to the invention.

FIG. 9 illustrates a typical fire extinguishing application having two reservoirs 80 connected to a distribution piping system 81, containing laterals which terminate at nozzles or distributors 82. The insulated reservoirs 80 are charged with water which is heated to above atmospheric to the desired pressure and temperature by means of electric heating elements 83. Pressurised hot water is released from the reservoirs 80 by activating release valves 85,86.

Figure 10:
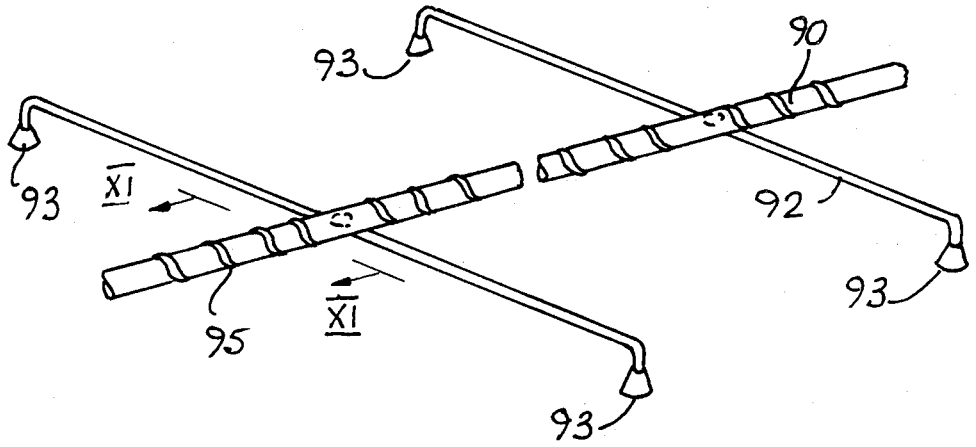
FIG. 10 is a schematic perspective view of a further apparatus according to the invention.
Figure 11:
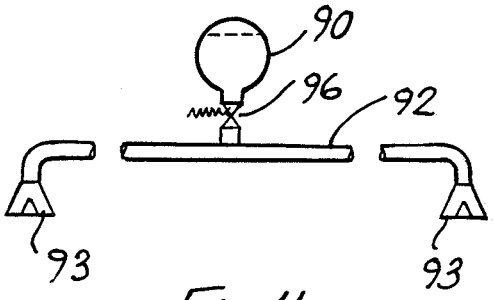
FIG. 11 is a side view on the line XI—XI in FIG. 10.

FIG. 10 and 11 illustrate an alternative fire extinguishing arrangement. In this case the reservoir is provided as a length of pipe 90. Attached to the underside of the pipe 90 are laterals 92 which terminate in nozzles or distributors 93. The pipe 90 is heated to the required pressure and temperature by means of an electric heat tracing element 95 spirally wrapped around the outside of the pipe. The pipe is also insulated to prevent heat loss. Pressured hot water is released from the pipe 90 by activation of release valves 96, such as solenoid valves which are positioned at the underside of pipe, there being one release valve 96 per lateral 92 as will be particularly apparent from FIG. 11. Fire conditions are detected by approved sensors which can detect heat, flames, smoke, combustible vapour, etc. The speed of release and volume of the pressurised hot water will depend on the particular application required. On detection of fire the valves are opened to deliver a charge of pressured hot water into the area in which the nozzles or distributors are sited. When the hot pressurised water is introduced into an area at a pressure higher than that in the area portion of the water forms vapour and portion of the water flashes off as steam. The water droplets and steam act to inhibit particle heat transfer and possible chemical reaction between fuel and oxygen. The water droplets and steam also extinguish fire by cooking and/or by dilution or reduction of oxygen.

Wherever air or gas is used to pre-pressurise, the initial charge pressure can calculated to allow for the temperature increase which, in an enclosed volume, will give rise to a corresponding pressure increase. This will apply to the suppression units and differential pressure diaphragm. Pre-pressurising the suppression units is optional for particular applications, the unit-generated flash steam can also be used.

It will be appreciated that various additional chemicals may be added to the pressurised hot water charge to achieve desired results in explosion suppression and/or fire extinguishing.

I claim:

1. An explosion suppression apparatus for suppressing an explosion in an enclosure, the apparatus being responsive to explosive conditions, the apparatus comprising:

static reservoir means for containing pressurised water at a pressure substantially above atmospheric pressure;

heating means for heating the water in the static reservoir means without adding any water to the static reservoir means, said heating means having said water to substantially increase the liquid heat content of the water, the static reservoir means having an outlet means through which hot pressurised water is delivered to an enclosure;

valve means for closing the outlet means, the valve means having an inlet side which is in direct contact with the hot pressurized water in the reservoir;

sensing means for detecting said explosion conditions;

actuating means, responsive to said sensing means, for opening the valve means in response to fire or explosion conditions occurring in the enclosure to introduce the pressurised hot water from the static reservoir means into the enclosure at a pressure higher than that in the enclosure, to suppress an explosion in the enclosure and to prevent re-ignition, a portion of the heat content imparted by heating the pressurized hot water being converted into discharge potential energy and kinetic energy to discharge the pressurized hot water from the reservoir means; and a further portion of the heat content imparted by heating the pressurized hot water being converted into additional potential and kinetic energy on introduction into the lower pressure enclosure causing a secondary increase in velocity and fragmentation into fine particles which by virtue of their elevated temperature substantially instantaneously absorb heat in the enclosure forming a vapour cloud and flash steam to reduce the oxygen concentration in the enclosure to prevent re-ignition.

2. Apparatus as claimed in claim 1 wherein the static reservoir means includes a pipeline having an outlet means into an enclosure.

3. Apparatus as claimed in claim 2 wherein the pipeline comprises a ring main extending substantially around the enclosure and having a plurality of spaced-apart outlet means into the enclosure.

4. Apparatus as claimed in claim 2 wherein the pipeline comprises a section extending along at least portion of the enclosure and having a plurality of spaced-apart outlet means into the enclosure.

5. Apparatus as claimed in claim 1 wherein the heating means comprises one of a steam or electrical trace heater and a hot air dryer.

6. Apparatus as claimed in claim 1 wherein the static reservoir means includes a pressurized suppression vessel.

7. Apparatus as claimed in claim 6 wherein the heating means comprises one of an electrically powered heating element and a heating coil through which steam is led to heat the water in the pressurised suppression vessel.

8. Apparatus as claimed in claim 1 wherein the valve means comprises differential pressure diaphragm means, including a pair of diaphragms which are spaced apart to define a pressurized space therebetween, the pressurised space having an outlet for pressure release; and actuating means for releasing pressure from the pressurized space to allow bursting of the diaphragms, introducing a charge of explosion suppressant material into the enclosure from the reservoir in response to said explosion conditions.

9. Apparatus as claimed in claim 8 wherein the differential pressure maintained in the space is released on activation of a valve in response to explosion conditions occurring in an enclosure communicating with the diaphragm.

10. Apparatus as claimed in claim 8 further including means for minimizing the air space between the diaphragms.

11. Apparatus as claimed in claim 10 wherein the space is pressurised with one of an incompressible fluid and a high boiling point inert liquid.

12. Apparatus as claimed in claim 10 wherein the space is partially filled with an insert which is ejected from the diaphragms, on bursting.

13. Apparatus as claimed in claim 12 wherein the insert is of an inert, preferably water soluble material.

14. In an explosion suppression apparatus operative in response to explosion conditions, a differential pressure diaphragm which is interposed between a reservoir of explosion suppressant material and an enclosure, the diaphragm comprising:

a pair of spaced-apart diaphragms defining therebetween a pressurized space, the pressurised space having an outlet for pressure release; and actuating means for releasing the pressure from the space to allow bursting of the diaphragms in response to said explosion conditions, the explosion suppressant material being introduced into the enclosure in response to said explosion conditions.

15. A differential pressure diaphragm as claimed in claim 14 wherein the differential pressure maintained in the space is released on activation of a valve in response to explosion conditions occurring in an enclosure communicating with the diaphragm.

16. A differential pressure diaphragm as claimed in claim 14 wherein means are provided to minimise the air space between the diaphragms.

17. A differential pressure diaphragm as claimed in claim 16 wherein the space is pressurised with an incompressible fluid such as water or a high boiling point inert liquid.

18. A differential pressure diaphragm as claimed in claim 16 wherein the space is partially filled with an insert which is ejected from the diaphragms, on bursting.

19. A differential pressure diaphragm as claimed in claim 18 wherein the insert is of an inert, preferably water soluble material.

* * * * *